United States Patent [19]

Sato, Kohei

[11] 3,986,080

[45] Oct. 12, 1976

[54] OIL-IMMERSED TYPE FLYBACK TRANSFORMER DEVICE

[75] Inventor: Sato, Kohei, Ikeda, Japan

[73] Assignee: Matsushita Electric Industrial Co., Ltd., Osaka, Japan

[22] Filed: Dec. 3, 1974

[21] Appl. No.: 529,103

Related U.S. Application Data

[63] Continuation of Ser. No. 390,689, Aug. 23, 1973, abandoned, which is a continuation of Ser. No. 232,566, March 7, 1972, abandoned.

[30] Foreign Application Priority Data

Mar. 9, 1971 Japan ..... 46-12937

[52] U.S. Cl. ..... 317/100; 174/17 LF; 317/103; 336/92; 336/94

[51] Int. Cl.[2] ..... H01F 27/02

[58] Field of Search ..... 336/90, 92, 94, 55, 336/58; 174/17 R, 17 LF; 317/100, 103

[56] References Cited

UNITED STATES PATENTS

| | | | |
|---|---|---|---|
| 2,816,947 | 12/1957 | Leightner | 336/94 X |
| 3,234,493 | 2/1966 | Zwelling et al. | 174/17 R |
| 3,634,798 | 1/1972 | Astleford, Jr. | 336/92 |
| 3,644,858 | 2/1972 | Galloway | 336/92 |
| 3,670,276 | 6/1972 | Theodore | 336/94 |

FOREIGN PATENTS OR APPLICATIONS

| | | | |
|---|---|---|---|
| 123,018 | 3/1944 | Australia | 336/94 |

OTHER PUBLICATIONS

*Modern Dielectric Materials*, Heywood and Company, Ltd., 1960, p. 146.

*Primary Examiner*—Thomas J. Kozma
*Attorney, Agent, or Firm*—Stevens, Davis, Miller & Mosher

[57] ABSTRACT

An oil-immersed type flyback transformer device wherein the container for the flyback transformer is made of plastic, whereby the ratio between the temperature coefficient of expansion of the capacity of the container with respect to the original capacity and the composite temperature coefficient of expansion of the volume of the whole assembly housed in the sealed container including the insulating oil is with respect to the original volume maintained within a predetermined range.

9 Claims, 4 Drawing Figures

OIL-IMMERSED TYPE FLYBACK TRANSFORMER DEVICE

This is a continuation of application Ser. No. 390,689 filed Aug. 23, 1973 (now abandoned) which is a continuation of application Ser. No. 232,566 filed Mar. 7, 1972 (now abandoned).

The present invention relates to an oil-immersed type flyback transformer device having an improved sealed container for receiving a flyback transformer therein.

It is the object of the present invention to provide an oil-immersed type flyback transformer device wherein the internal oil pressure of the sealed container hardly varies with change of temperature and moreover stray capacitance can hardly arise.

In a known oil-immersed type flyback transformer device, the sealed container for the flyback transformer is made of metal so that the side plates can dilate and cave-in in response to the expansion and contraction caused by change of the volume of the oil in the sealed container, according to change of the temperature of the oil. This, however, results in variation of the capacitance between the coil and the metal container due to the dilation and depression of the metal and thus ringing of the flyback transformer cannot be maintained at a normal level. This excessive ringing can cause, for example, a reduction in the high-tension output voltage. Particularly, with devices of the type which contain a high voltage rectifier diode therein, the capacitance between the diode and the metal container can result in an increase in the internal loss of the diode, non-uniformity of voltage borne by the diode and the like which may cause a premature breakdown of the diode. To eliminate these deficiencies, it is necessary to use a container having an excessively large rating.

Another disadvantage of the conventional oil-immersed type flyback transformer devices is that since the insulation distance between the high voltage output terminal or the low voltage output terminal and the metal container is made smaller, the construction of the devices tends to be more complicated in order to ensure the voltage withstanding ability of the respective terminals.

The present invention is contemplated to solve these difficulties and it will now be explained with reference to the accompanying drawings showing preferred embodiments of the invention, in which.

Figure 3:
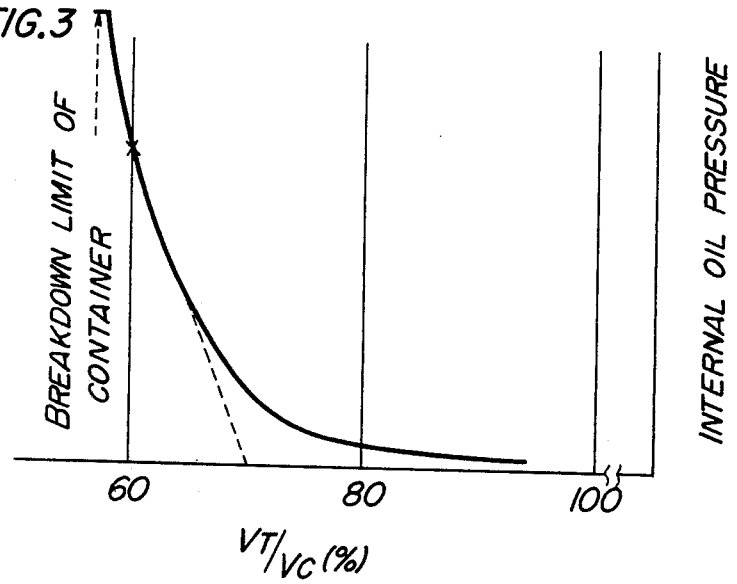
Figure 4:
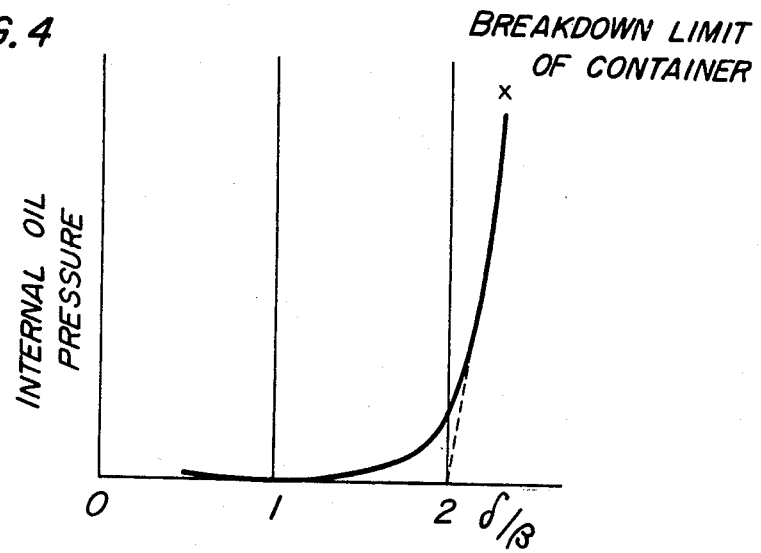

FIG. 3 is a diagram showing the relationship between the variation of the internal oil pressure and the ratio ($V_T/V_C$) of the total volume $V_T$ of the internal assembly of the flyback transformer device to the capacity $V_C$ of the sealed container; and FIG. 4 is a diagram showing the relationship between the variation of the internal oil pressure and the ratio $\delta/\beta$ of the composite temperature coefficient of expansion $\delta$ of the volume of the whole assembly including the insulating oil to the temperature coefficient of expansion $\beta$ of the capacity of the sealed container.

Figure 1:
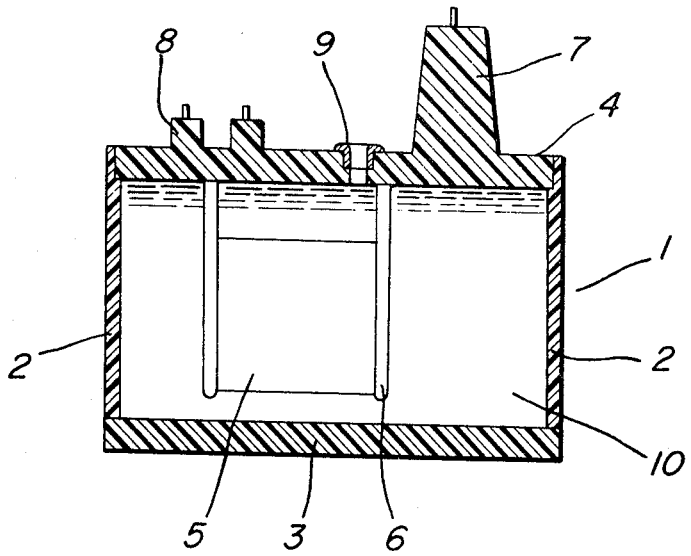
FIG. 1 is a longitudinal sectional view showing an embodiment of the present invention.

Referring first to FIG. 1, numeral 1 designates a sealed container of a non-flexible or rigid plastic material comprising lateral side plates 2 made of a plastic non-flexible material reinforced with long glass fibers and a container base plate 3 and an upper cover 4 which are made of a non-reinforced non-flexible plastic material. Accordingly, the thickness of the base plate 3 and the upper cover 4 is three to five times the thickness of the lateral side plates 2. A flyback transformer 5 is secured to the lower side of the upper cover 4 with metal fittings 6, while a high voltage terminal 7 and other terminals 8 as well as an eyelet 9 for sealing an opening through which oil is introduced are preliminarily formed integrally with the upper cover 4. The upper cover 4 is fitted in the sealed container 1 and they are further securely bonded together with epoxy resin, for example. In this manner, the flyback transformer 5 is immersed in an insulating oil 10 and the respiratory action of the container in response to variation of the oil volume is effected at the side plates 2.

According to the present invention, the sealed container is made of a non-flexible or rigid plastic and at the same time the volumetric variation with temperature of the insulating oil filled into the sealed container is absorbed by the difference between the variation of the capacity of the sealed container with temperature and the variation of the volume of the internal assembly with temperature, thereby reducing the internal oil pressure applied to the sealed container due to the variation of the oil volume. By forming the sealed container 1 from a non-flexible plastic the side plates 2 do not dilate in response to the expansion and contraction of the insulating oil 10 with the container as in known oil-immersed flyback transformer devices.

In other words, if the original volume of the insulating oil is denoted by $V_O$, and the temperature coefficient of expansion of the volume of the insulating oil with respect to the original volume ($V_O$) is $\alpha$; and the original capacity of the sealed container is $V_C$ and the temperature coefficient of expansion of the capacity of the container with respect to the original capacity ($V_C$) is $\beta$; and further where the original total volume of the internal assembly including the ferrite core, copper wires, and insulating material, etc. is $V_T$ and the temperature coefficient of expansion of the total volume of the internal assembly with respect to the original volume ($V_T$) is $\gamma$; than generally the following relation is obtained:

$$\alpha > \beta > \gamma \tag{1}$$

and the following formula also holds:

$$V_C = V_O + V_T \tag{2}$$

In order that the sealed container may not be subjected to the internal oil pressure due to temperature changes, with the temperature change being denoted by T, the following formula must hold:

$$V_C(1 + \beta T) = V_O(1 + \alpha T) + V_T(1 + \gamma T) \tag{3}$$

Thus, according to the above formulas (2) and (3), the ratio $V_T/V_C$ is given by the following formula:

$$\frac{V_T}{V_C} = \frac{\alpha - \beta}{\alpha - \gamma} \tag{4}$$

FIG. 3 represents the relationship between the internal oil pressure applied to the sealed container and the ratio $V_T/V_C$ obtained according to the formula (4), the relationship being obtained by the experiments conducted. As will be seen from FIG. 3, it is understood that if the ratio $V_T/V_C$ is greater than about 70%, then the internal oil pressure varies only slightly even if there is some deviation from the formula (4).

On the other hand, applying the above conditions to formula (4), the relationship between the internal oil pressure applied to the sealed container due to temperature changes and the ratio of the composite temperature coefficient $\delta$ of the volume of the whole assembly housed in the sealed container including the insulating oil with respect to the original volume, to the temperature coefficient of expansion $\beta$, the capacity of the sealed container can be plotted as shown in FIG. 4. Where $\delta$ is given by the following formula:

$$\delta = \left(\frac{V_0}{V_0 + V_T}\right)\alpha + \left(\frac{V_T}{V_0 + V_T}\right)\gamma.$$

It is seen from this figure that variation of the internal oil pressure with change of temperature is small, if the above ratio of the two temperature coefficients satisifies the relation $(\delta/\beta) \leqq 2$. In this case, if the relation $(\delta/\beta) \leqq 2$ is satisfied, the relation $V_T/V_C \geqq 70\%$ can also be met simultaneously. Moreover, while the volume, temperature coefficient of expansion, etc. differ depending on the design of a flyback transformer, such differences are so small that they can be neglected in consideration of the economy, etc. of the oil-immersed type flyback transformer device.

Figure 2:
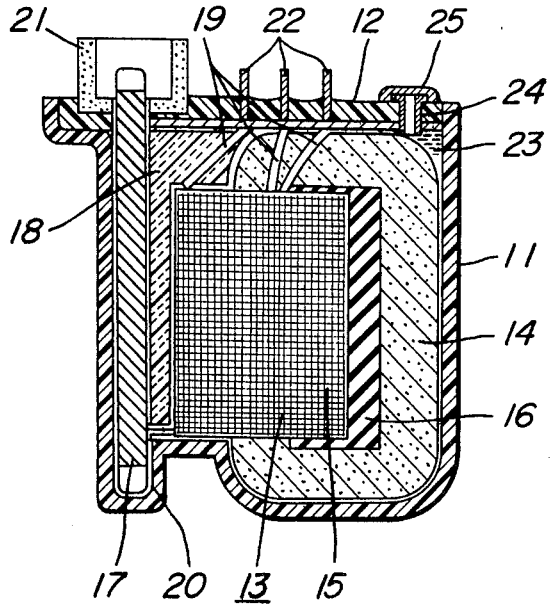
FIG. 2 is a sectional view of an oil-immersed type flyback transformer device according to another embodiment of the present invention.

The present invention provides oil-immersed type flyback transformer devices which satisfy the aforementioned conditions, and another embodiment of the present invention will now be explained with reference to FIG. 2. In the figure, numeral 11 designates a sealed non-flexible container which is made of epoxy resin and whose capacity and the temperature coefficient of expansion are 225 cc and $5 \times 10^{-5}/°$ C, respectively; 12 a cover member made of epoxy resin; 13 a flyback transformer housed in the sealed container 11 comprising a ferrite core 14, a coil 15 and a coil bobbin (not shown). Numeral 16 designates a metal oxide of 60 cc filled between the ferrite core 14 and the coil 15; 17 a high voltage diode mounted in the sealed container 11; 18 a spacer disposed between the flyback transformer 13 and the high voltage diode 17, the spacer 18 being made of polypropylene and adapted to prevent the transmission of heat to the high voltage diode 17. Lead wires 19 and 20 are led to the outside through a high voltage terminal 21 and low voltage terminals 22. Numeral 23 designates an insulating oil supplied through an oil receiving hole 24 and filling the space in the sealed container 11, the insulating oil consisting of a silicone oil whose temperature coefficient of expansion (volume) is $9.0 \times 10^{-4}/°$ C; 25 a resinous material for sealing the oil receiving hole 24. The total volume of the internal assembly including the ferrite core 14, coil 15, lead wires 19 and 20, spacer 18, metal oxide 16 and high voltage diode 17 is 205 cc and the temperature coefficient of expansion (volume) is $1.5 \times 10^{-5}/°$ C.

With the device of this embodiment constructed as described above, the experiments conducted showed that the variation of the internal oil pressure for a temperature change of 50° C was almost zero.

The experiments conducted with an oil-immersed type flyback transformer device almost identical with the device of the second embodiment excepting that the capacity of the sealed container 11 was 170 cc with no metal oxide 16 being employed also showed that the variation of the internal oil pressure for the temperature change of 50° C was almost zero.

With the devices of the above-described embodiments, the ratio of the composite temperature coefficient of expansion of the volume of the internal assembly housed in the sealed container including the insulating oil with respect to the original volume to the temperature coefficient of expansion of the capacity of the sealed container with respect to the original capacity is maintained below 2.0 with the result that variation of the internal oil pressure with change of temperature is reduced almost to zero, that there are no danger of the oil leakage and the like, and that since the sealed container 11 is made of a non-flexible epoxy resin, stray capacitance can hardly arise and the sealed container 11, the coil 15 and others can be arranged close together. This permits the device to be smaller and more compact and reduces the quantity of insulating oil, while variation of the insulating oil volume with temperature is prevented with the resultant prevention of variation in the characteristics of the flyback transformer. Moreover, since stray capacitance can hardly arise, there is no reduction in the voltage withstanding property of the high voltage diode 17 with resultant improvement in the reliability of the high voltage diode 17. Furthermore, according to the second embodiment, the constructions of the terminals 21 and 22 can be made simpler and the design of the internal insulation can also be simplified. Still further, no respiratory mechanism is needed. Moreover, while the metal containers in the conventional devices are made of paramagnetic materials such as brass and aluminum, the container used with the device of the present invention is made of a non-flexible epoxy resin and thus it can be formed with ease and inexpensively.

As explained above, in the oil-immersed type flyback transformer device of the present invention the sealed container is made of a non-flexible plastic and the flyback transformer is housed in the sealed container, and thus there are advantages, as follows:

1. Variation of the oil volume can cause no variation in the stray capacitance induced in the transformer coil, thereby permitting the maintenance of a normal level of ringing.

2. The stray capacitance induced in the diode is much smaller than is the case when the metal container is employed and the heat generated by the diode is also small. Thus, the voltage borne by the diode is made practically uniform with the resultant remarkable improvement in the reliability of the diode.

3. Since the container is made of non-flexible plastic, the creeping insulation distance of the high voltage output terminal can be increased considerably, thereby completely eliminating the danger of fault in the high tension circuit due to flashover, etc.

4. Since reinforced plastic is used for the container, the strength of the container against its fatigue failure due to the cave in and dilation of the container sides caused by the variation of the oil volume is considerably improved up to a value which is 10 to 30 times the strength of a container which is entirely made of an ordinary plastic.

5. Since the temperature coefficient of expansion of plastic is approximately equal to that of the oil, there is practically no effective variation in the oil volume which exerts any oil pressure on the container. For this reason, as compared with the case where the metal container is employed, the internal oil pressure is considerably reduced with an improved hermetic seal.

Furthermore, the present invention is characterized in that the ratio $\delta/\beta$ of the composite temperature coefficient of expansion $\delta$ of the volume of the whole internal assembly housed in the sealed container including the insulating oil and the temperature coefficient of expansion $\beta$ of capacity of the sealed container is maintained less than 2.0, and thus the present invention has the following advantages:

1. The internal oil pressure hardly varies with change of temperature and thus there is no danger of the oil leakage and the like with the resultant improvement in the hermetic seal.

2. Since stray capacitance can hardly arise, the sealed container, coil and others can be arranged close together, thereby making the device smaller and more compact.

3. Since the volume of the insulating oil hardly varies with change of temperature, there is no change in the characteristics of the flyback transformer and the reliability of the high voltage diode is also improved.

4. The constructions of the terminals are simpler and no respiratory mechanism is needed, and moreover the internal insulation is simplified. Thus, the device is simple in construction and inexpensive to manufacture.

What is claimed is:

1. An oil-immersed type flyback transformer device comprising a sealed non-flexible plastic container, said container having a thermal volume expansion coefficient $\beta$; a flyback transformer assembly sealed within said container; and an insulating oil filling between said transformer assembly and said container without an air gap remaining therein, the entire internal combination within said container including said flyback transformer assembly and said insulating oil having a thermal volume expansion coefficient $\delta$, the ratio $\delta/\beta$ being maintained below 2.0 for holding the internal pressure variations of said oil at substantially zero irrespective of variations in the temperature of said device.

2. A device according to claim 1 wherein only silicone oil is used as said insulating oil.

3. An oil-immersed insulation type flyback transformer device comprising a sealed non-flexible plastic container, said container having a thermal volume expansion coefficient $\beta$; a flyback transformer assembly sealed within said container and having a ferrite core, said container being in close proximity to said flyback transformer and an insulating oil filling the space between said transformer assembly and said container without an air gap remaining therein, the whole internal combination within said container including said flyback transformer assembly and said insulating oil having a thermal volume expansion coefficient $\delta$, where $\delta$ is defined by the equation $$\delta = \left(\frac{V_O}{V_O + V_T}\right)\alpha + \left(\frac{V_T}{V_O + V_T}\right)\gamma$$

wherein $V_O$ and $V_T$ are the volumes of said insulating oil and flyback transformer assembly respectively and $\alpha$ and $\gamma$ are the thermal volume expansion coefficients of said insulating oil and flyback transformer respectively, the ratio $\delta/\beta$ being maintained below 2.0, the amount of insulating oil required in said device being minimized and variations in internal pressure of said oil due to temperature variations being substantially eliminated.

4. A device according to claim 3 wherein said insulating oil is a silicone oil.

5. A device according to claim 3 wherein said transformer assembly further comprises a transformer coil, and a spacer made of metal oxide interposed between said ferrite core and said transformer coil, and wherein said insulating oil is a silicone oil.

6. A device according to claim 3 wherein the side plates of said plastic container are reinforced with fibrous materials.

7. A device according to claim 3 wherein said plastic container is formed of epoxy resin.

8. An oil-immersed type flyback transformer device comprising a sealed non-flexible plastic container, said container having a thermal volume expansion coefficient $\beta$, a flyback transformer assembly having a ferrite core; a high voltage diode for rectifying the output voltage of said flyback transformer; and an insulating oil filling said container without an air gap remaining therein, the entire internal combination within said container including said flyback transformer assembly, said high voltage diode and said insulating oil having a thermal volume expansion coefficient $\delta$, the ratio $\delta/\beta$ being maintained below 2.0, the amount of insulating oil required in said device being minimized and variations in internal pressure of said oil due to temperature variations being substantially eliminated.

9. A device according to claim 7, wherein the epoxy resin forming said plastic container has a temperature coefficient of expansion on the order of $5 \times 10^{-5}/°$ C.

* * * * *